US011282623B2

(12) United States Patent
Okura et al.

(10) Patent No.: US 11,282,623 B2
(45) Date of Patent: Mar. 22, 2022

(54) COIL COMPONENT AND METHOD OF MANUFACTURING SAME

(71) Applicant: Murata Manufacturing Co., Ltd., Kyoto (JP)

(72) Inventors: Ryo Okura, Nagaokakyo (JP); Yoichi Nakatsuji, Nagaokakyo (JP); Kosuke Ishida, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 866 days.

(21) Appl. No.: 16/035,150

(22) Filed: Jul. 13, 2018

(65) Prior Publication Data

US 2019/0035527 A1 Jan. 31, 2019

(30) Foreign Application Priority Data

Jul. 25, 2017 (JP) ..... JP2017-143636

(51) Int. Cl.
*H01F 5/00* (2006.01)
*H01F 5/04* (2006.01)
(Continued)

(52) U.S. Cl.
CPC ..... *H01F 5/04* (2013.01); *H01F 5/06* (2013.01); *H01F 17/0013* (2013.01); *H01F 27/292* (2013.01); *H01F 41/042* (2013.01)

(58) Field of Classification Search
USPC ..... 336/192, 200, 232, 198
See application file for complete search history.

(56) References Cited

U.S. PATENT DOCUMENTS 7,453,343 B2 * 11/2008 Ito ..... H01F 17/0013 336/200
2007/0199734 A1 * 8/2007 Kudo ..... H01F 41/041 174/255

(Continued)

FOREIGN PATENT DOCUMENTS

JP H08-124745 A 5/1996
JP H11-243017 A 9/1999

(Continued)

OTHER PUBLICATIONS

An Office Action; "Notice of Reasons for Refusal," mailed by the Japanese Patent Office dated Oct. 1, 2019, which corresponds to Japanese Patent Application No. 2017-143636 and is related to U.S. Appl. No. 16/035,150; with English language translation.

*Primary Examiner* — Shawki S Ismail
*Assistant Examiner* — Kazi S Hossain
(74) *Attorney, Agent, or Firm* — Studebaker & Brackett PC

(57) ABSTRACT

A coil component comprising a first coil conductor layer wound on a plane, a lead-out conductor led out on the same plane as the first coil conductor layer from an outer-circumferential end of the first coil conductor layer, an insulating layer laminated on the first coil conductor layer and the lead-out conductor, and a second coil conductor layer laminated on the insulating layer and wound on a plane. The first coil conductor layer and the second coil conductor layer concentrically overlap with each other when viewed in a lamination direction, and the lead-out conductor has a connecting portion connected to the first coil conductor layer and provided with a coil extension part extending to overlap with the second coil conductor layer when viewed in the lamination direction.

20 Claims, 14 Drawing Sheets

(51) Int. Cl.

| | |
|---|---|
| ***H01F 27/29*** | (2006.01) |
| ***H01F 41/04*** | (2006.01) |
| ***H01F 5/06*** | (2006.01) |
| ***H01F 17/00*** | (2006.01) |

(56) References Cited

U.S. PATENT DOCUMENTS

| | | | | |
|---|---|---|---|---|
| 2015/0235755 | A1 | 8/2015 | Ozaki et al. | |
| 2015/0340150 | A1* | 11/2015 | Nakamura | H01F 17/0013 336/200 |
| 2016/0094082 | A1* | 3/2016 | Ookawa | H01F 38/14 320/108 |

FOREIGN PATENT DOCUMENTS

| | | | |
|---|---|---|---|
| JP | 2002-271111 | A | 9/2002 |
| JP | 2003-330161 | A | 11/2003 |
| JP | 2014-063838 | A | 4/2014 |
| JP | 2015-133523 | A | 7/2015 |
| JP | 2016-063229 | A | 4/2016 |

* cited by examiner

-Prior Art-

COIL COMPONENT AND METHOD OF MANUFACTURING SAME

CROSS REFERENCE TO RELATED APPLICATION

This application claims benefit of priority to Japanese Patent Application 2017-143636 filed Jul. 25, 2017, the entire content of which is incorporated herein by reference.

BACKGROUND

Technical Field

The present disclosure relates to a coil component and a method of manufacturing the same.

Background Art

A conventional coil component is described in Japanese Laid-Open Patent Publication No. 2015-133523. This coil component has a spiral first coil conductor layer, an insulating layer laminated on the first coil conductor layer, and a spiral second coil conductor layer laminated on the insulating layer. A lead-out conductor is led radially outward from an outer-circumferential end of the first coil conductor layer, and the lead-out conductor is connected to an electrode. The first coil conductor layer and the second coil conductor layer overlap with each other when viewed is a lamination direction. The lead-out conductor intersects with the second coil conductor layer when viewed in the lamination direction. The second coil conductor layer overlaps with a connecting portion of the lead-out conductor connected to the first coil conductor layer when viewed in the lamination direction.

SUMMARY

Reductions in size and height of coil components are recently desired, and it has been discovered that a new problem occurs in the reductions in size and height of the conventional coil component as described above.

More specifically, since the reductions in size and height result in reductions in wiring interval in the coil conductor layers and distance between the first and second coil conductor layers, reflected light (exposure light) from a lower layer of the second coil conductor layer is not negligible when the second coil conductor layer is manufactured by photolithography. Since the reductions in size and height also result in reductions in line width and film thickness of the coil conductor layers, thinning due to poor exposure may have a significant influence on characteristics, or breaking may occur.

The present disclosure provides a coil component and a method of manufacturing the same capable of reducing thinning or disconnection of a coil conductor layer overlapping with a lead-out conductor when viewed in a lamination direction.

A coil component of an aspect of the present disclosure comprises a first coil conductor layer wound on a plane; a lead-out conductor led out on the same plane as the coil conductor layer from an outer-circumferential end of the first coil conductor layer; an insulating layer laminated on the first coil conductor layer and the lead-out conductor; and a second coil conductor layer laminated on the insulating layer and wound on a plane. The first coil conductor layer and the second coil conductor layer concentrically overlap with each other when viewed in a lamination direction. The lead-out conductor has a connecting portion connected to the first coil conductor layer and provided with a coil extension part extending to overlap with the second coil conductor layer when viewed in the lamination direction.

According to the coil component, since the lead-out conductor has the connecting portion connected to the first coil conductor layer and provided with the coil extension part, the coil extension part overlaps with the second coil conductor layer at a portion adjacent to a portion overlapping with the connecting portion of the lead-out conductor when viewed in the lamination direction. Therefore, when the second coil conductor layer is manufactured by photolithography, the occurrence of thinning or disconnection can be reduced in the second coil conductor layer at a portion adjacent to a portion overlapping with the connecting portion of the lead-out conductor.

In an embodiment of the coil component, the coil component has a first dummy conductor layer wound on the same plane as the first coil conductor layer on the outside of the first coil conductor layer without being electrically connected to the first coil conductor layer, and a second dummy conductor layer wound on the same plane as the second coil conductor layer on the outside of the second coil conductor layer without being electrically connected to the second coil conductor layer. The first dummy conductor layer and the second dummy conductor layer concentrically overlap with each other when viewed in the lamination direction. When viewed in the lamination direction, the lead-out conductor has an intersecting portion intersecting with the second dummy conductor layer and provided with a dummy extension part extending to overlap with the second dummy conductor layer.

According to the embodiment, when the second dummy conductor layer is manufactured by photolithography, the occurrence of thinning or disconnection can be reduced in the second dummy conductor layer at a portion adjacent to a portion overlapping with the intersecting portion of the lead-out conductor.

In an embodiment of the coil component, the coil component comprises a first coil conductor layer wound on a plane; a lead-out conductor led out on the same plane as the coil conductor layer from an outer-circumferential end of the first coil conductor layer; and an insulating layer laminated on the first coil conductor layer and the lead-out conductor. The coil component further comprises a second coil conductor layer laminated on the insulating layer and wound on a plane; a first dummy conductor layer wound on the same plane as the first coil conductor layer on the outside of the first coil conductor layer without being electrically connected to the first coil conductor layer; and a second dummy conductor layer wound on the same plane as the second coil conductor layer on the outside of the second coil conductor layer without being electrically connected to the second coil conductor layer. The first coil conductor layer and the second coil conductor layer concentrically overlap with each other when viewed in a lamination direction. The first dummy conductor layer and the second dummy conductor layer concentrically overlap with each other when viewed in the lamination direction, and when viewed in the lamination direction, the lead-out conductor has an intersecting portion intersecting with the second dummy conductor layer and provided with a dummy extension part extending to overlap with the second dummy conductor layer.

According to the embodiment, when the second dummy conductor layer is manufactured by photolithography, the occurrence of thinning or disconnection can be reduced in the second dummy conductor layer at a portion adjacent to a portion overlapping with the intersecting portion of the lead-out conductor.

In an embodiment of the coil component, the coil component has an electrode connected to the lead-out conductor, the lead-out conductor has a lead-out part extending from an outer circumferential end of the first coil conductor layer to the electrode, and the lead-out part is orthogonal to the outer circumferential end of the first coil conductor layer when viewed from the lamination direction.

According to the embodiment, since the lead-out conductor is orthogonal to the outer circumferential end of the first coil conductor layer when viewed from the lamination direction, when the second coil conductor layer is manufactured by photolithography, the occurrence of thinning or disconnection can further be reduced in the second coil conductor layer at a portion adjacent to a portion overlapping with the connecting portion of the lead-out conductor.

In an embodiment of the coil component, the first coil conductor layer has a thickness of 5 μm or more and 15 μm or less (i.e., from 5 μm to 15 μm).

According to the above embodiment, the first coil conductor layer has a thickness of 5 μm or more and 15 μm or less (i.e., from 5 μm to 15 μm), and the thickness of the first coil conductor layer is large; however, since the coil extension part is disposed, the occurrence of thinning or disconnection can be reduced in the second coil conductor layer.

In an embodiment of the coil component, the second coil conductor layer has an aspect ratio of 1 or more and 2.5 or less (i.e., from 1 to 2.5).

According to the embodiment, since the second coil conductor layer has an aspect ratio of 1 or more and 2.5 or less (i.e., from 1 to 2.5), the second coil conductor layer is manufactured by photolithography; however, since the coil extension part is disposed, the occurrence of thinning or disconnection can be reduced in the second coil conductor layer.

A method of manufacturing a coil component according to an aspect of the present disclosure comprises the steps of disposing a first coil conductor layer wound on a plane and a lead-out conductor led out on the same plane as the coil conductor layer from an outer-circumferential end of the first coil conductor layer to the outside and disposing a coil extension part extending along a winding shape of the first coil conductor layer at a connecting portion of the lead-out conductor connected to the first coil conductor layer; laminating an insulating layer on the first coil conductor layer and the lead-out conductor; and disposing a photoresist on the insulating layer. The method further comprises exposing the photoresist after a light shield is placed at positions overlapping with the first coil conductor layer and the coil extension part when viewed in the lamination direction; removing a portion not exposed due to the mask; and disposing a second coil conductor layer in the removed portion of the photoresist.

According to the manufacturing method of the coil component, the second coil conductor layer overlaps with the first coil conductor layer and the coil extension part when viewed in the lamination direction. Therefore, the coil extension part overlaps with the second coil conductor layer at a portion adjacent to a portion overlapping with the connecting portion of the lead-out conductor when viewed in the lamination direction. Therefore, when the second coil conductor layer is manufactured by photolithography, the occurrence of thinning or disconnection can be reduced in the second coil conductor layer at a portion adjacent to a portion overlapping with the connecting portion of the lead-out conductor.

The coil component and the method of manufacturing the same of the present disclosure can reduce occurrence of thinning or disconnection of the coil conductor layer overlapping with the lead-out conductor when viewed in the lamination direction.

DETAILED DESCRIPTION

A coil component according to an embodiment of the present disclosure will now be described in detail with reference to shown embodiments.

First Embodiment

Figure 1:
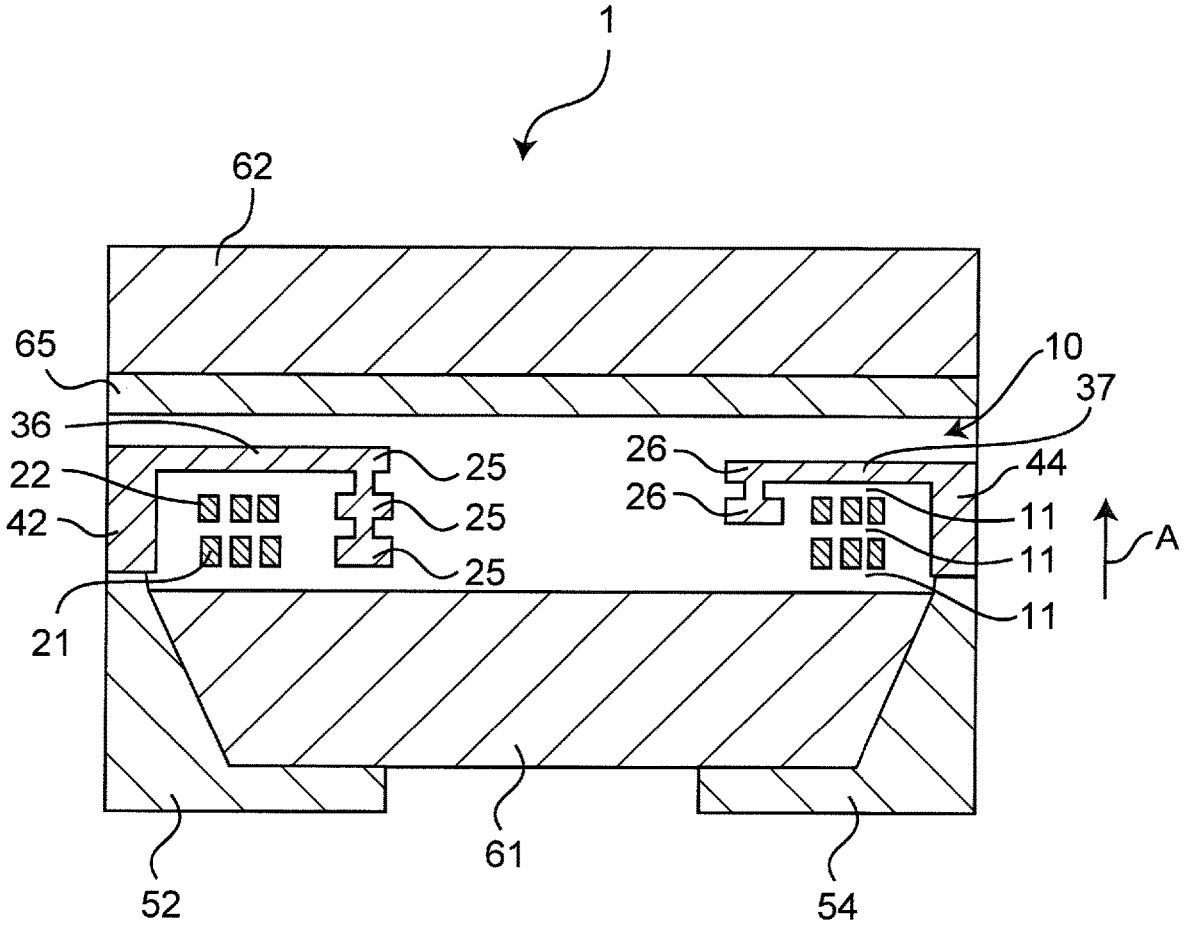
FIG. 1 is a cross-sectional view of a first embodiment of a coil component of the present disclosure.
Figure 2A:
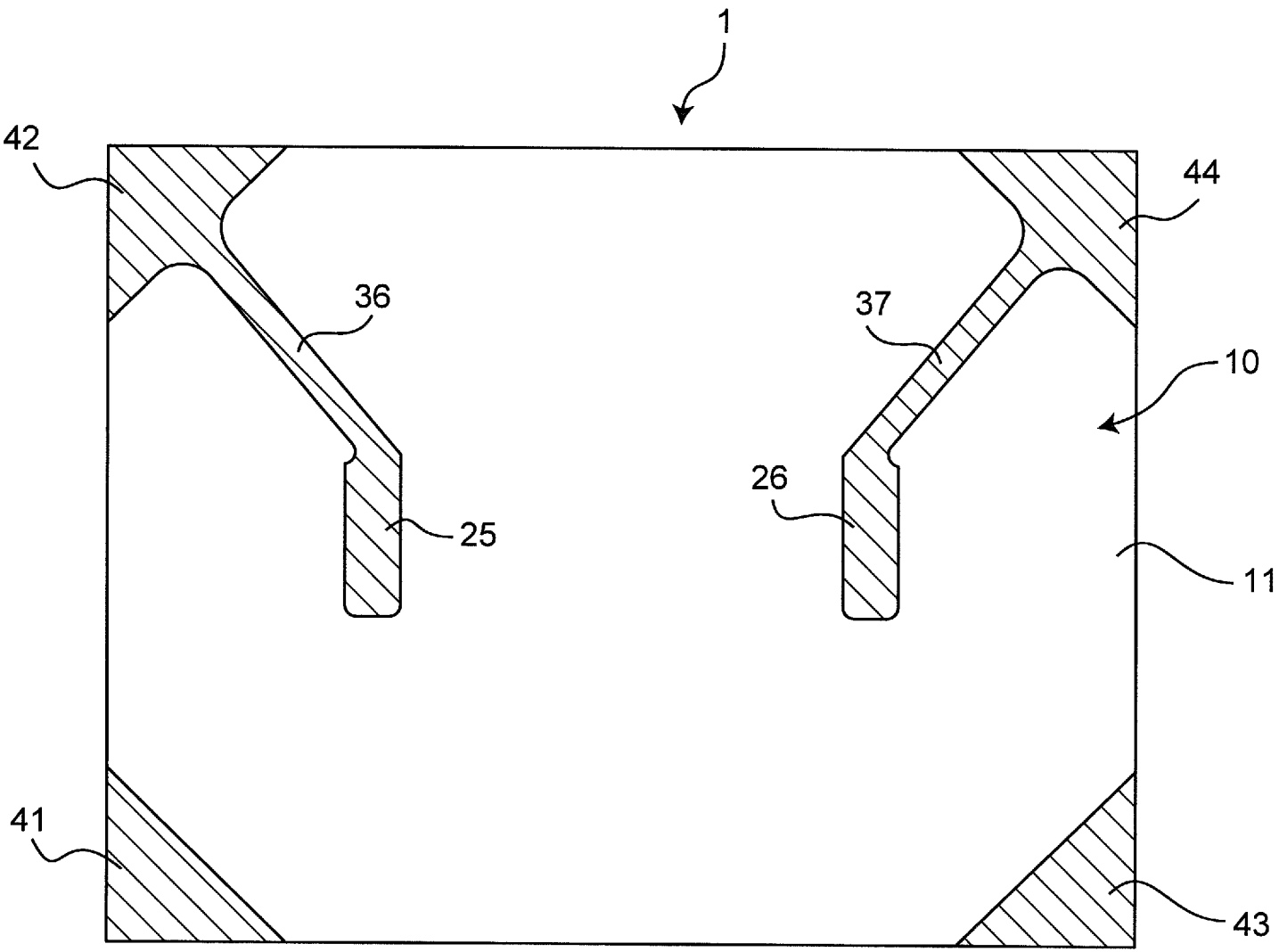
FIG. 2A is an exploded plane view of a portion of the coil component.
Figure 2B:
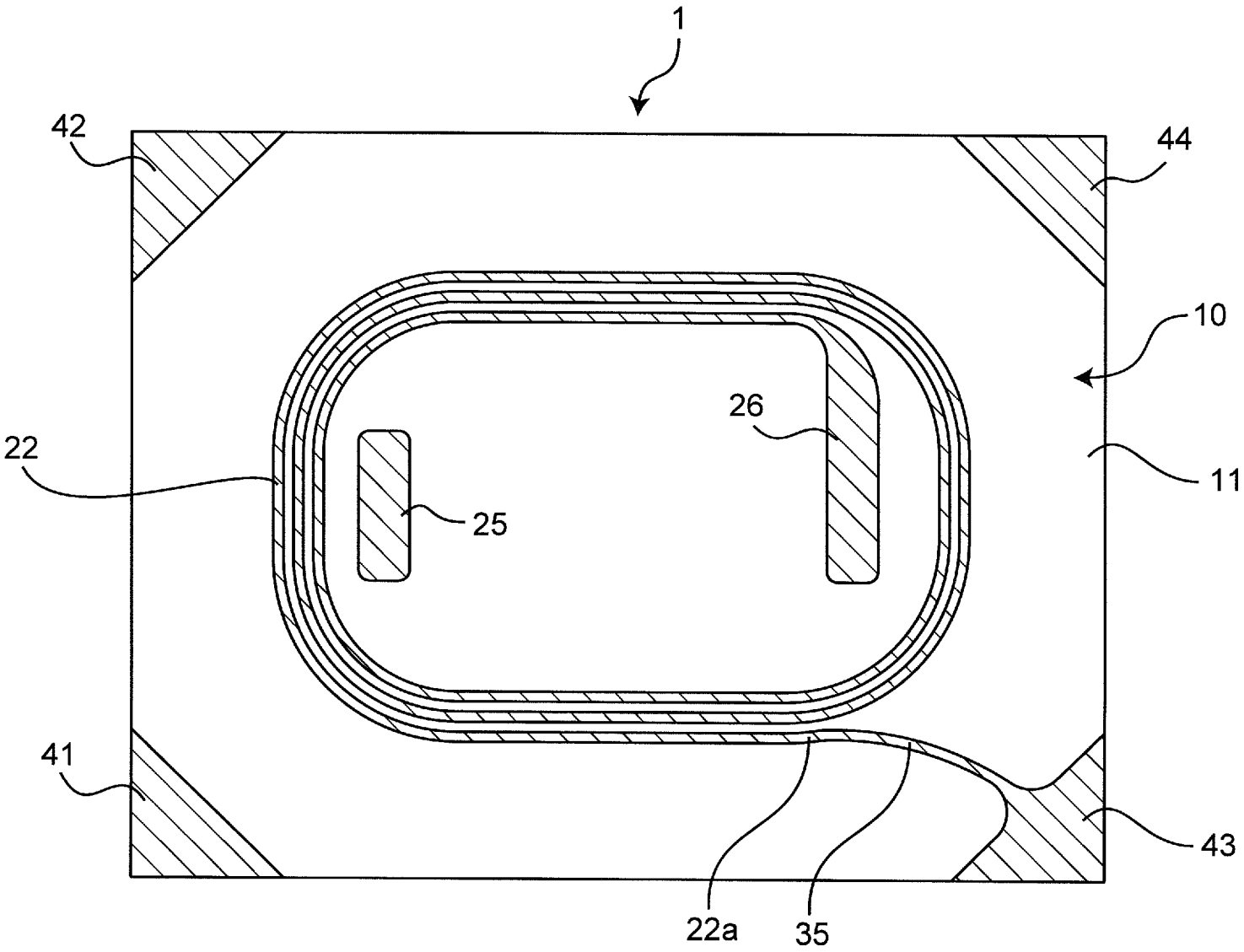
FIG. 2B is an exploded plane view of a portion of the coil component.
Figure 2C:
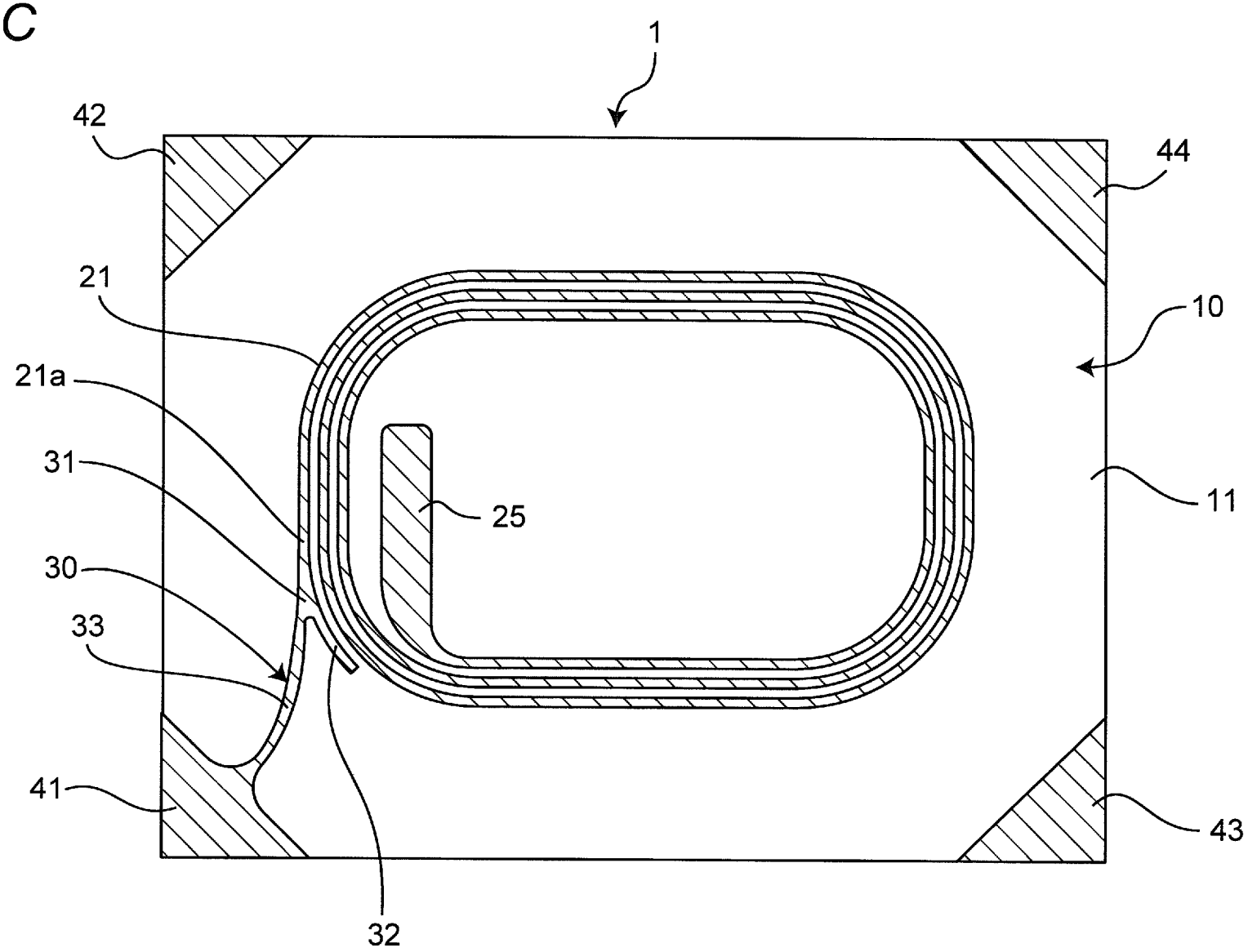
FIG. 2C is an exploded plane view of a portion of the coil component.

FIG. 1 is a cross-sectional view of a first embodiment of a coil component. FIGS. 2A, 2B, and 2C are exploded plane views of a portion of the coil component. As shown in FIGS. 1 and 2A to 2C, a coil component 1 has an element body 10, a first coil conductor layer 21 and a second coil conductor layer 22 disposed within the element body 10, and connection electrodes 41 to 44 and external electrodes 51 to 54 (external electrodes 51, 53 are not shown) electrically connected to the first and second coil conductor layers 21, 22.

The coil component 1 is electrically connected through the electrodes 41 to 44, 52, 54 to a wiring of a circuit board not shown. The coil component 1 is used as a common mode choke coil, for example, and is used for an electronic device such as a personal computer, a DVD player, a digital camera, a TV, a portable telephone, automotive electronics, and medical/industrial machines.

The element body 10 includes multiple insulating layers 11, and the multiple insulating layers 11 are laminated in a lamination direction A. The insulating layers 11 is made of an insulating material mainly composed of resin, ferrite, and glass, for example. In the element body 10, an interface between the multiple insulating layers 11 may not be clear due to firing etc. The element body 10 is formed into a substantially rectangular parallelepiped shape. In FIG. 1, the lamination direction A is defined as a vertical direction. FIGS. 2A to 2C show layers in order from an upper layer to a lower layer. The lamination direction A merely shows an order in a process, and the top and bottom of the coil component 1 may be reversed (configuration in which the external electrodes 51 to 54 are on the upper side).

A first substrate 61 is disposed on a lower surface of the element body 10, and a second substrate 62 is disposed on an upper surface of the element body 10. The second substrate 61 is attached via an adhesive 65 to the upper surface of the element body 10. The first and second substrates 61, 62 are ferrite substrates, for example. A ferrite material used for the first and second substrates 61, 62 may be a magnetic or nonmagnetic material. The first and second substrates 61, 62 may be made of a material other than ferrite, such as alumina and glass.

The electrodes 41 to 44, 52, 54 are made of a conductive material such as Ag, Cu, Au, and an alloy mainly composed thereof, for example. The electrodes include the first to fourth connection electrodes 41 to 44 and the first to fourth external electrodes 52, 54. The first to fourth connection electrodes 41 to 44 are respectively embedded in corner portions of the element body 10 along the lamination direction A. The first to fourth external electrodes 52, 54 are disposed from the lower surface to the side surface of the element body 10. The first connection electrode 41 is connected to the first external electrode; the second connection electrode 42 is connected to the second external electrode 52; the third connection electrode 43 is connected to the third external electrode; and the fourth connection electrode 44 is connected to the fourth external electrode 54.

The first coil conductor layer 21 and the second coil conductor layer 22 are made of the same conductive material as the electrodes 41 to 44, 52, 54, for example. The first and second coil conductor layers 21, 22 each have a flat spiral shape wound on a plane. The numbers of turns of the first and second coil conductor layers 21, 22 are not less than one or may be less than one. The first and second coil conductor layers 21, 22 are disposed on respective different insulating layers 11 and are arranged in the lamination direction A. The first coil conductor layer 21 is disposed on the lower side of the second coil conductor layer 22.

A first lead-out conductor 30 is disposed on the same plane (on the same insulating layer 11) as the first coil conductor layer 21. The first lead-out conductor 30 is led outward from an outer-circumferential end 21*a* of the first coil conductor layer 21 and connected to the first connection electrode 41. The outer-circumferential end 21*a* refers to a portion deviated from the spiral shape of the first coil conductor layer 21, and the first lead-out conductor 30 refers to a portion after the outer-circumferential end 21*a*. The first lead-out conductor 30 and the first coil conductor layer 21 are integrally formed.

An inner-circumferential end of the first coil conductor layer 21 is connected to a first connection conductor 25 disposed in the element body 10 along the lamination direction A. The first connection conductor 25 is connected to a third lead-out conductor 36 disposed on the insulating layer 11 on the upper side of the second coil conductor layer 22, and the third lead-out conductor 36 is connected to the second connection electrode 42. In this way, the first coil conductor layer 21 is connected to the first connection electrode 41 and the second connection electrode 42.

A second lead-out conductor 35 is disposed on the same plane (on the same insulating layer 11) as the second coil conductor layer 22. The second lead-out conductor 35 is led outward from an outer-circumferential end 22*a* of the second coil conductor layer 22 and connected to the third connection electrode 43.

An inner-circumferential end of the second coil conductor layer 22 is connected to a second connection conductor 26 disposed in the element body 10 along the lamination direction A. The second connection conductor 26 is connected to a fourth lead-out conductor 37 disposed on the insulating layer 11 on the upper side of the second coil conductor layer 22, and the fourth lead-out conductor 37 is connected to the fourth connection electrode 44. In this way, the second coil conductor layer 22 is connected to the third connection electrode 43 and the fourth connection electrode 44.

The second coil conductor layer 22 is laminated on the insulating layer 11 laminated on the first coil conductor layer 21 and the first lead-out conductor 30. The first coil conductor layer 21 and the second coil conductor layer 22 concentrically overlap with each other when viewed in the lamination direction A. In this description, "overlap" means that the spiral shape of the first coil conductor layer 21 and the spiral shape of the second coil conductor layer 22 substantially overlap, and the shapes may partially have non-overlapping portions due to differences in shape itself or slight misalignment.

Figure 3:
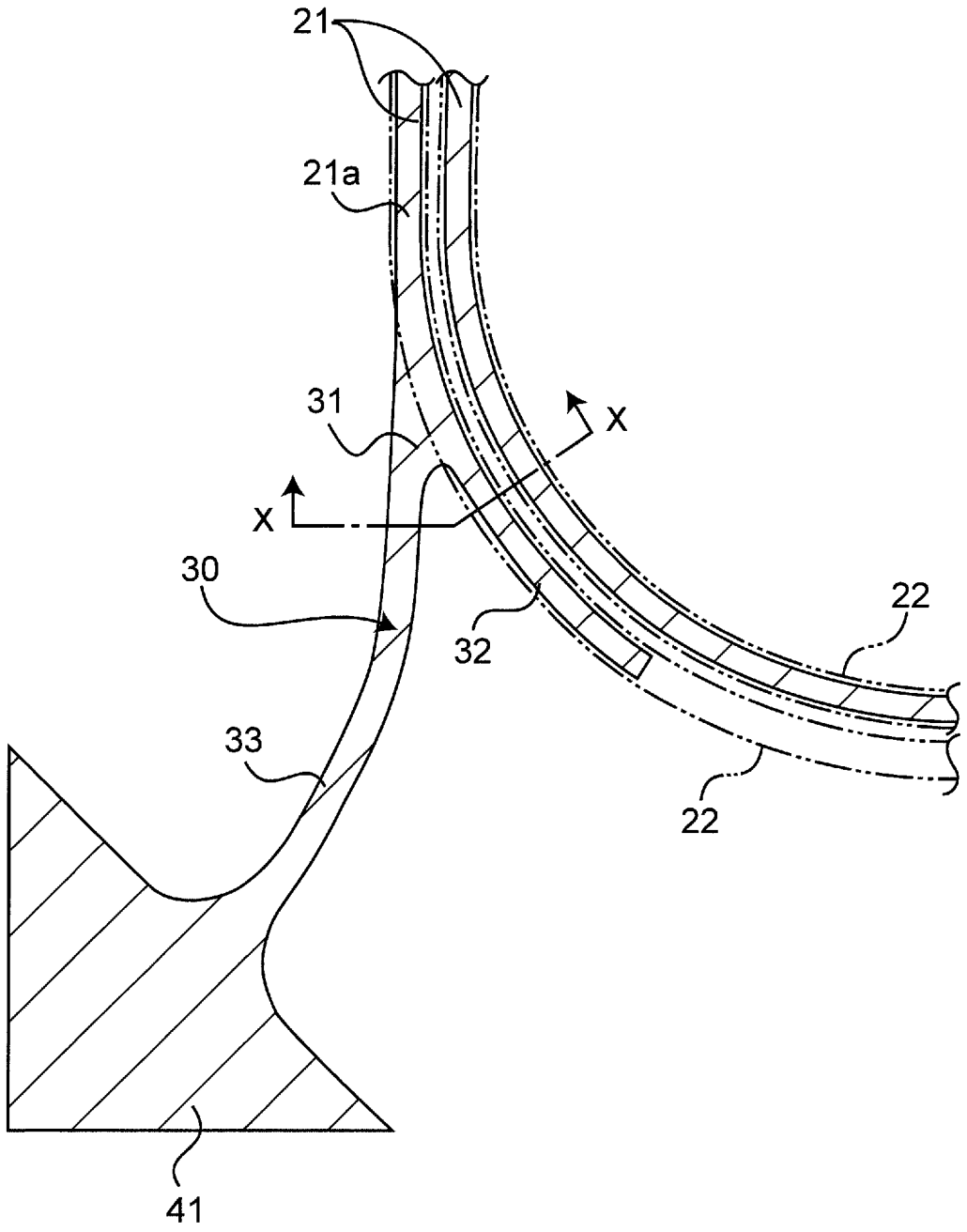
FIG. 3 is an enlarged view of a first lead-out conductor viewed in a lamination direction.

FIG. 3 is an enlarged view of the vicinity of the first lead-out conductor 30 viewed in the lamination direction. In FIG. 3, the first lead-out conductor 30, the first coil conductor layer 21, and the first connection electrode 41 are indicated by hatching, and the second coil conductor layer 22 located thereabove is indicated by imaginary lines. Although the line width of the second coil conductor layer 22 is drawn wider than the width of the first coil conductor layer 21, the widths are actually the same. The line width in this case refers to a dimension orthogonal to an extending direction of the first coil conductor layer 21 and the second coil conductor layer 22 when viewed in the lamination direction. The line width of the first coil conductor layer 21 may be different from the line width of the second coil conductor layer 22.

As shown in FIG. 3, the first lead-out conductor 30 has a lead-out part 33 and a coil extension part 32. The lead-out part 33 extends from the outer circumferential end 21*a* of the first coil conductor layer 21 to the first connection electrode 41. The lead-out part 30 includes a connecting portion 31 connected to the first coil conductor layer 21. The coil extension part 32 is connected to the connecting portion 31. In FIG. 3, the connecting portion 31 is a portion between the outer-circumferential end 21*a* and a bifurcated position. The coil extension part 32 extends from the connecting portion 31.

The coil extension part 32 extends in one direction to overlap with the second coil conductor layer 22 when viewed in the lamination direction A. The length of the coil extension part 32 is shorter than the length of the lead-out part 33. The length in this case refers to a wiring length, i.e., the length of the branch conductor 32 and the lead-out part 33 in the extending direction. The length of the coil extension part 32 may be different from the length of the lead-out part 33.

A method of manufacturing the coil component 1 will be described. A manufacturing method in an X-X cross section of FIG. 3 will be described. The X-X cross section of FIG. 3 is a cross section in a direction orthogonal to the extending directions of a portion of the first lead-out conductor 30 after the connecting portion 31, the coil extension part 32, and the first coil conductor layer 21.

Figure 4A:
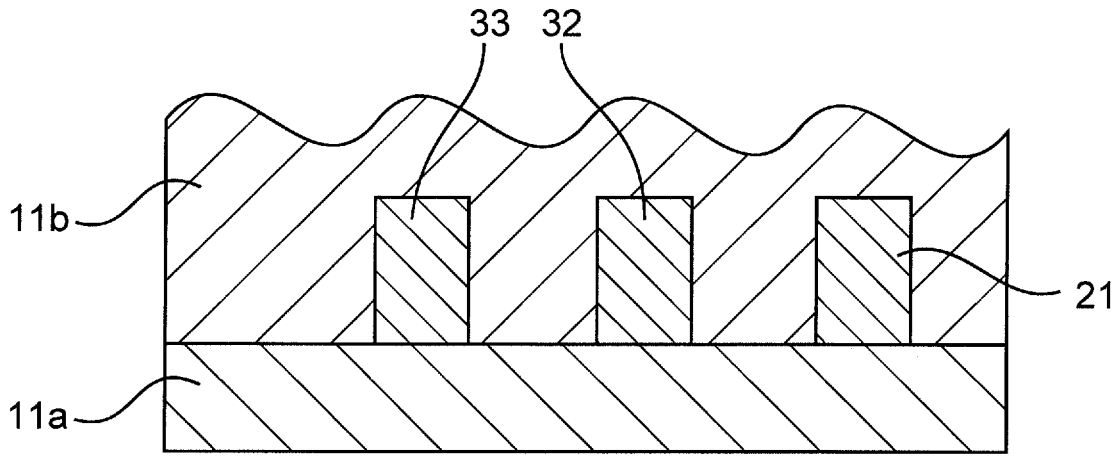
FIG. 4A is an explanatory view for explaining a manufacturing method of the coil component.

As shown in FIG. 4A, the first coil conductor layer 21 and the first lead-out conductor 30 are disposed on the first insulating layer 11*a*. The first lead-out conductor 30 includes the lead-out part 33 and the coil extension part 32. The second insulating layer 11*b* is laminated on the first coil conductor layer 21 and the first lead-out conductor 30. In this case, the upper surface of the second insulating layer 11*b* is made uneven due to a difference in level of the first coil conductor layer 21, the coil extension part 32, and the lead-out part 33 from the first insulating layer 11*a*. The upper surface of the second insulating layer 11*b* has a convex surface above the first coil conductor layer 21, the coil extension part 32, and the lead-out part 33.

Figure 4B:
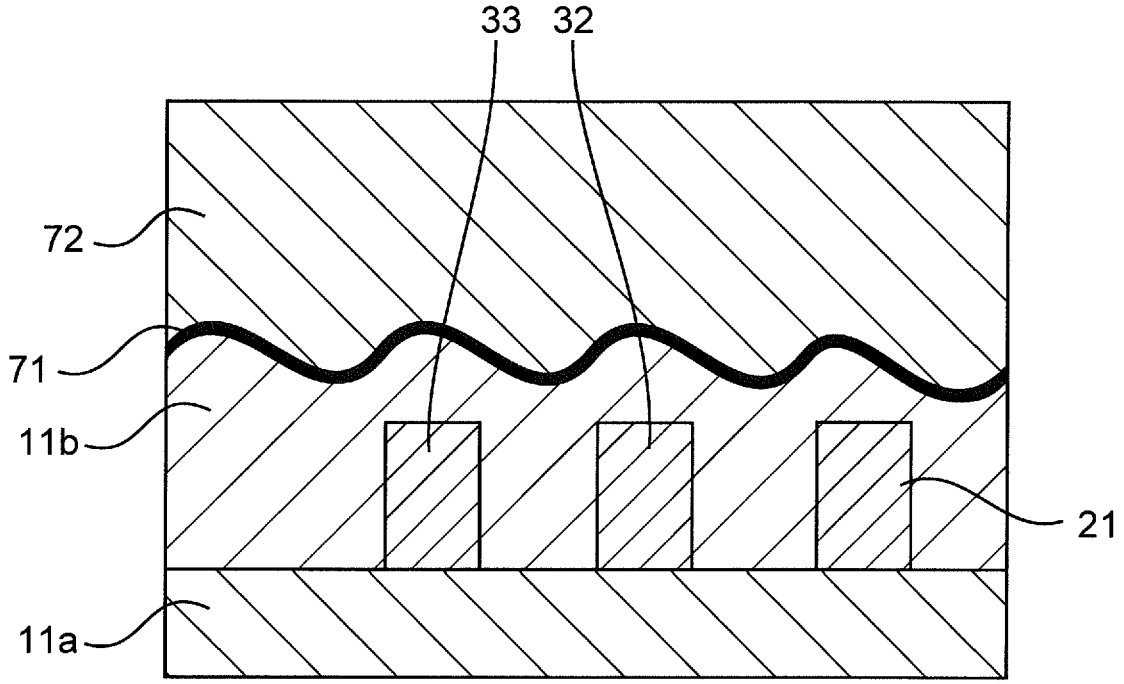
FIG. 4B is an explanatory view for explaining a manufacturing method of the coil component.

Subsequently, as shown in FIG. 4B, a power feeding film 71 is disposed on the upper surface of the second insulating layer 11*b*, and a photoresist 72 is disposed on the power feeding film 71.

Figure 4C:
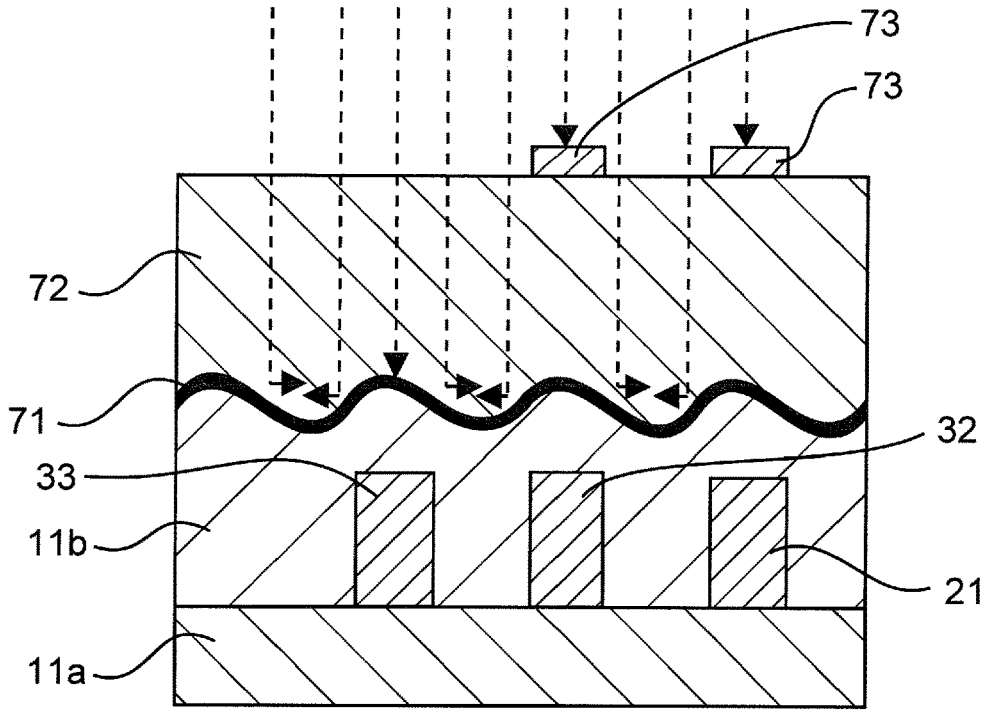
FIG. 4C is an explanatory view for explaining a manufacturing method of the coil component.

Subsequently, as shown in FIG. 4C, a mask 73 is disposed to shield light at positions overlapping with the first coil conductor layer 21 and the coil extension part 32 when viewed in the lamination direction. Therefore, the mask 73 overlaps with the convex surface of the upper surface of the second insulating layer 11*b*. The photoresist 72 is a negative resist. The mask 73 is placed in an exposure machine not shown. The mask may be placed in the exposure machine during manufacturing of the inductor component 1 or may preliminarily be disposed before manufacturing.

The photoresist 72 is then exposed. Light used for exposure goes into the photoresist 72 as indicated by dotted arrows. In this case, the light is reflected by slopes between the convex and concave surfaces of the second insulating layer 11*b*, and the light is reflected in a direction opposite to a region below the mask 73. Therefore, the light does not enter the region under the mask 73.

Figure 4D:
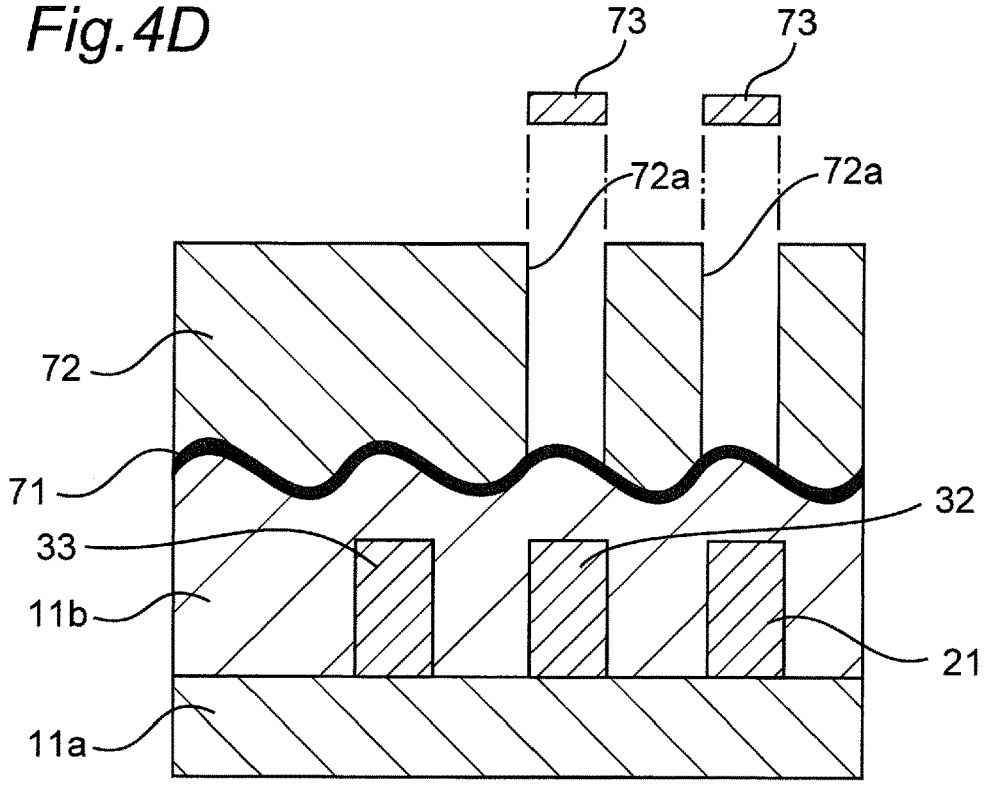
FIG. 4D is an explanatory view for explaining a manufacturing method of the coil component.

Subsequently, as shown in FIG. 4D, a portion not exposed due to the mask 73 is removed by development to form an opening 72*a* in the photoresist 72. Since the light reflected by the slopes of the second insulating layer 11*b* does not enter the region under the mask 73, the width of the opening 72*a* is the same as the width of the mask 73.

Figure 4E:
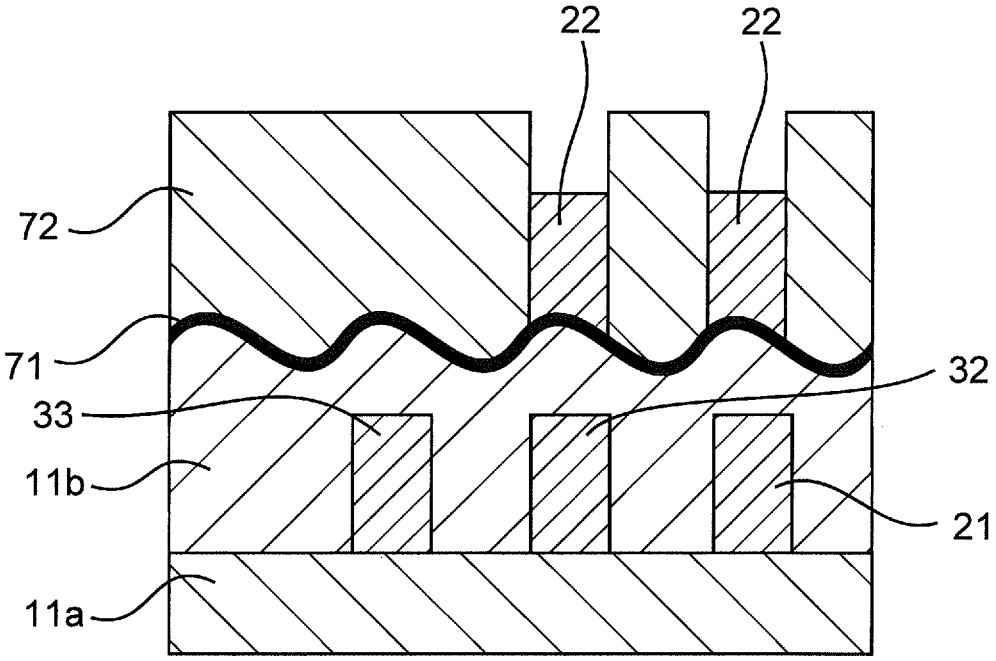
FIG. 4E is an explanatory view for explaining a manufacturing method of the coil component.
Figure 4F:
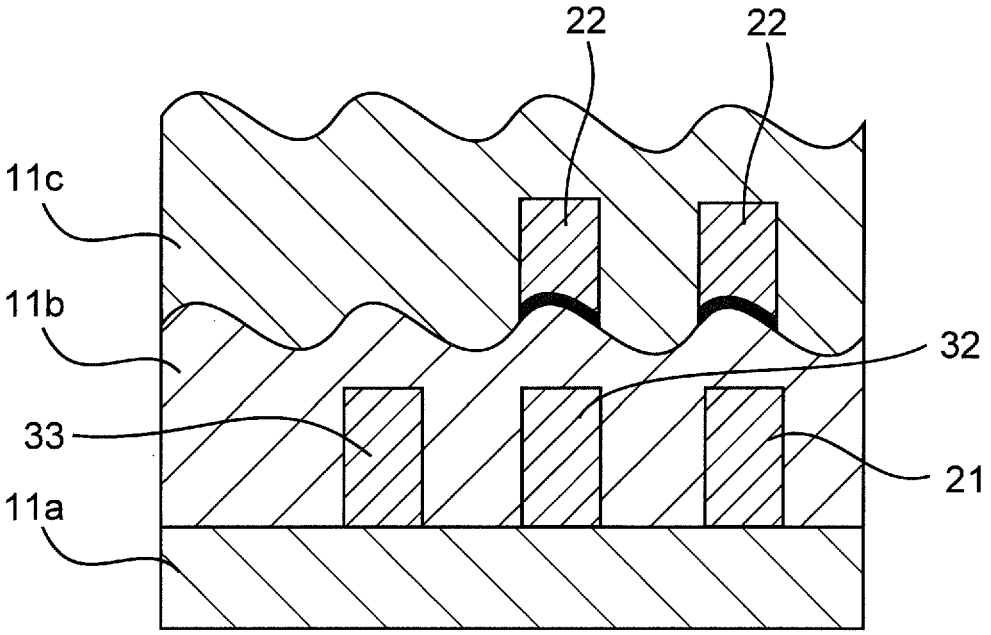
FIG. 4F is an explanatory view for explaining a manufacturing method of the coil component.

Subsequently, as shown in FIG. 4E, the second coil conductor layer 22 is disposed in the removed portion (the opening 72*a*) of the photoresist 72. The second coil conductor layer 22 is formed by plating by energizing the power feeding film 71. Subsequently, as shown in FIG. 4F, the photoresist 72 and the power feeding film 71 are removed, and a third insulating layer 11*c* is laminated on the second coil conductor layer 22.

Subsequently, as shown in FIG. 1, the element body 10 formed as described above is formed on the first substrate 61, and the second substrate 62 is formed on the element body 10. Although the formation of the lead-out wirings 36, 37 and the connection electrodes 41 to 44 etc. will not be described, a known method may be used. Subsequently, the external electrodes 51 to 54 are disposed to manufacture the coil component 1.

A method of manufacturing a comparative example of a conventional coil component having a first lead-out conductor 300 will be described with reference to FIGS. 5A to 5D. The first lead-out conductor 300 does not include the coil extension part 32 of the present disclosure. The same reference numerals as those of FIGS. 4A to 4F have the same configurations and thereof will not be described.

Figure 5A:
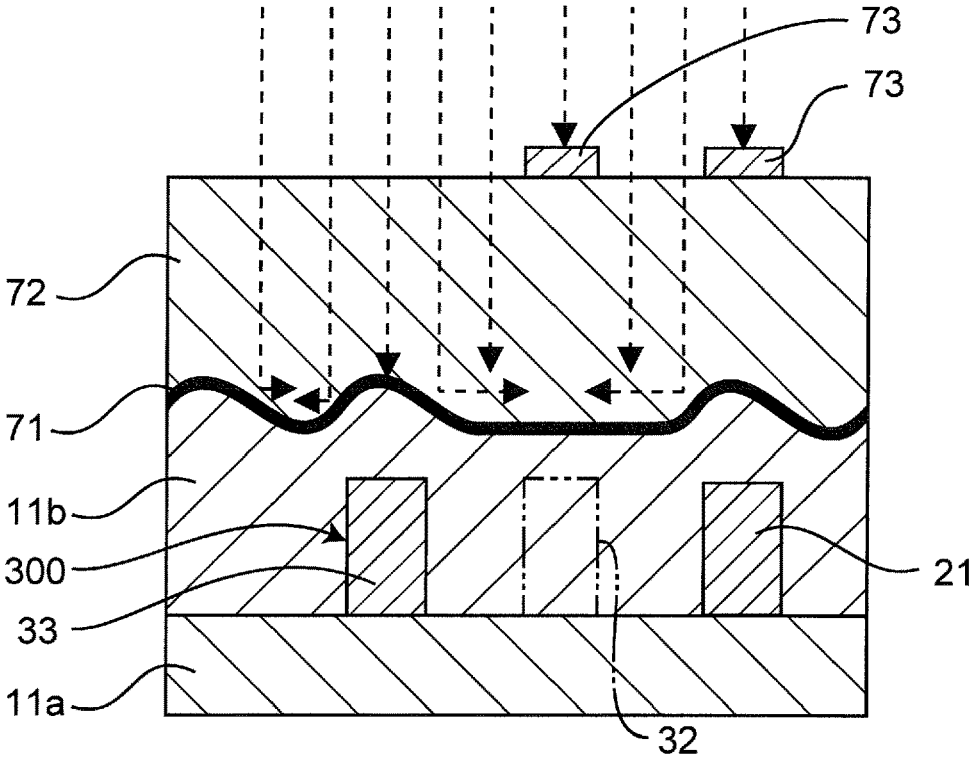
FIG. 5A is an explanatory view for explaining a manufacturing method of a comparative example of the coil component.

As shown in FIG. 5A, the upper surface of the second insulating layer 11*b* has a convex surface above the first coil conductor layer 21 and the lead-out part 33 of the first lead-out conductor 300. Since the coil extension part 32 does not exist between the first coil conductor layer 21 and the lead-out part 33, the upper surface of the second insulating layer 11*b* has a concave surface above between the first coil conductor layer 21 and the lead-out part 33. The mask 73 is disposed to overlap with the convex surface above the first coil conductor layer 21 and the concave surface above between the first coil conductor layer 21 and the lead-out part 33. When the photoresist 72 is exposed, the light is reflected by the inclined surface between the convex and concave surfaces of the second insulating layer 11*b* and enters the region under the mask 73 overlapping above the concave surface.

Figure 5B:
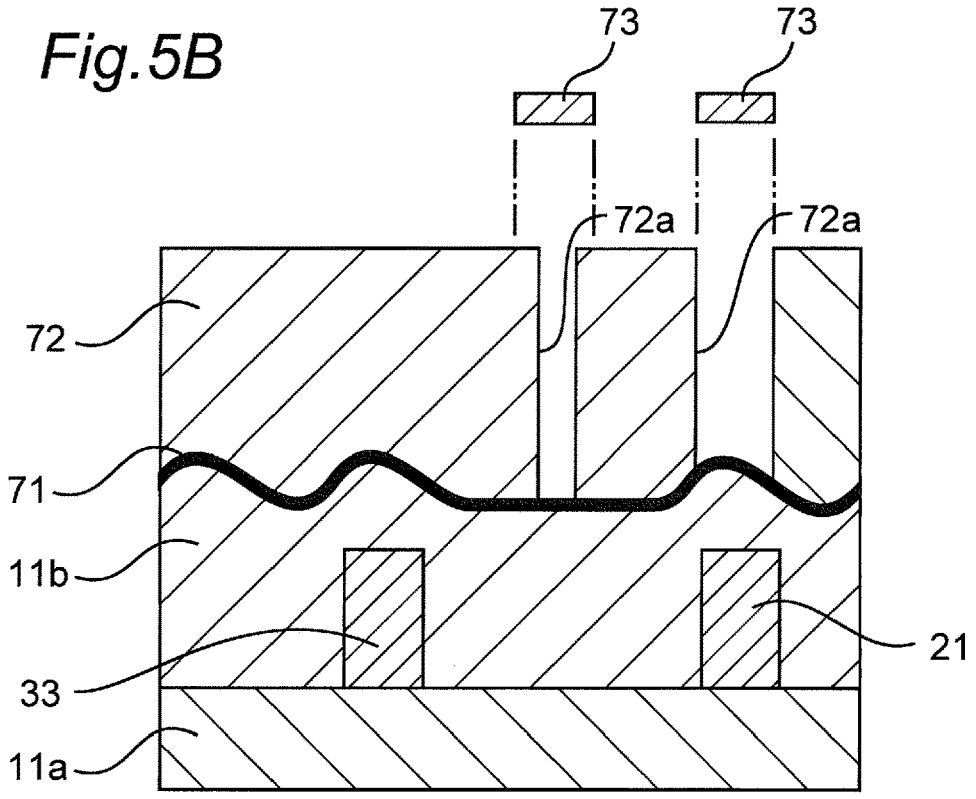
FIG. 5B is an explanatory view for explaining a manufacturing method of a comparative example of the coil component.

Subsequently, as shown in FIG. 5B, a portion not exposed by the mask 73 is removed by development to form the opening 72*a* in the photoresist 72. Since the light reflected by the slope of the second insulating layer 11*b* has entered the region under the mask 73 above the concave surface, the width of the opening 72*a* becomes narrower than the width of the mask 73.

Figure 5C:
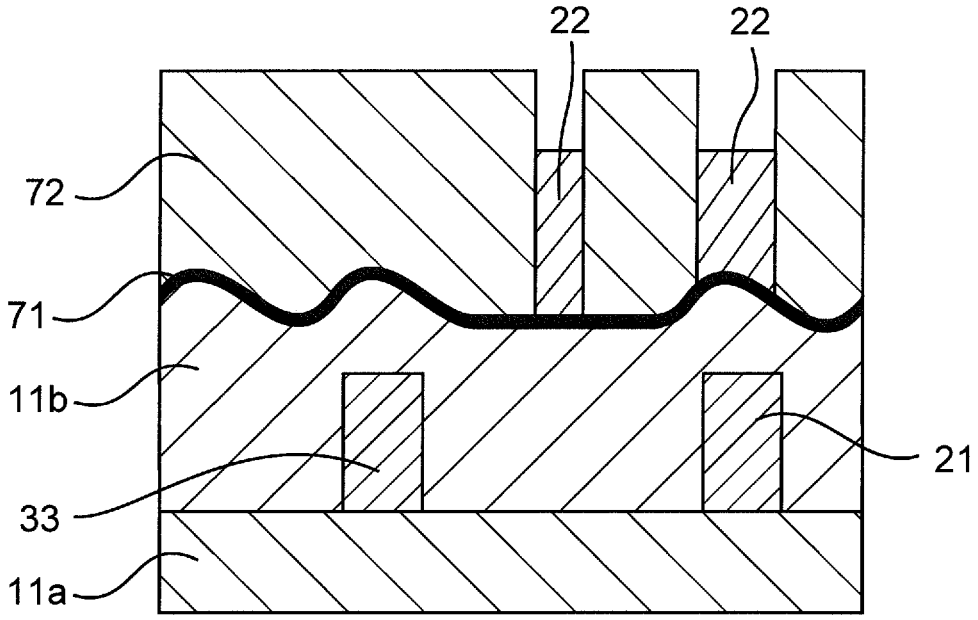
FIG. 5C is an explanatory view for explaining a manufacturing method of a comparative example of the coil component.
Figure 5D:
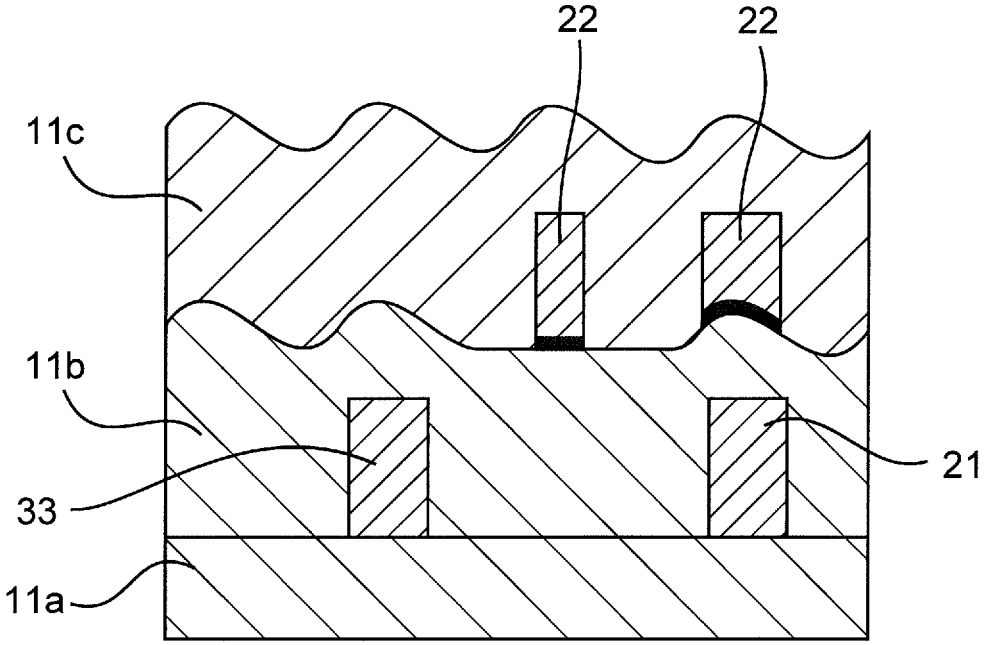
FIG. 5D is an explanatory view for explaining a manufacturing method of a comparative example of the coil component.

Subsequently, as shown in FIG. 5C, the second coil conductor layer 22 is disposed in the removed portion (the opening 72*a*) of the photoresist 72, and as shown in FIG. 5D, the photoresist 72 and the power feeding film 71 are removed before the third insulating layer 11*c* is laminated on the second coil conductor layer 22.

Therefore, the width of the second coil conductor layer 22 located above between the first coil conductor layer 21 and the lead-out part 33 is reduced, resulting in thinning of the second coil conductor layer 22. Specifically, referring to FIG. 3, thinning or disconnection occurs in the second coil conductor layer 22 at a portion adjacent to a portion overlapping with the connecting portion 31 of the first lead-out conductor 300. The disconnection of the second coil conductor layer 22 occurs when the opening 72*a* becomes narrower in the photoresist 72.

According to the coil component 1 and the method of manufacturing the same of the embodiment, as shown in FIG. 3, when viewed in the lamination direction A, the coil extension part 32 overlaps with the second coil conductor layer 22 at a portion adjacent to a portion overlapping with the connecting portion 31 of the first lead-out conductor 30 when viewed in the lamination direction A. As a result, when the second coil conductor layer 22 is manufactured by photolithography, as shown in FIG. 4D, the width of the opening 72*a* located above the coil extension part 32 is not narrowed, and as shown in FIG. 4E, the width of the second coil conductor layer 22 located above the coil extension part 32 is not reduced.

Therefore, the occurrence of thinning or disconnection can be reduced in the second coil conductor layer 22 at a portion adjacent to a portion overlapping with the connecting portion 31, i.e., in the second coil conductor layer 22 at a portion overlapping with the coil extension part 32.

According to the coil component 1, the thickness of the first coil conductor layer 21 in the lamination direction is preferably 5 μm or more and 15 μm or less (i.e., from 5 μm to 15 μm). Since the thickness of the first coil conductor layer 21 is set to 5 μm or more, a problem tends to occur due to the unevenness (difference in level) on the upper surface of the second insulating layer 11*b* as in the comparative example. Therefore, the effect of the coil extension part 32 reducing the occurrence of thinning or disconnection of the second coil conductor layer 22 becomes more significant. On the other hand, since the thickness of the first coil conductor layer 21 is set to 15 μm or less, the limit of manufacturing is not exceeded. The thickness of the second coil conductor layer 22 is preferably 5 μm or more and 15 μm or less (i.e., from 5 μm to 15 μm). The "thickness" is the layer thickness of the coil conductor layer and refers to the thickness in the direction along the lamination direction A.

According to the coil component 1, the aspect ratio of the second coil conductor layer 22 is preferably 1 or more and 2.5 or less (i.e., from 1 to 2.5). The aspect ratio is (the thickness of the second coil conductor layer 22)/(the line width of the second coil conductor layer 22). In the coil component 1, since the occurrence of thinning or disconnection of the second coil conductor layer 22 due to exposure is reduced, the second coil conductor layer 22 having such a high aspect ratio can be formed by photolithography. The aspect ratio of the first coil conductor layer 21 is preferably 1 or more and 2.5 or less (i.e., from 1 to 2.5).

Second Embodiment

Figure 6:
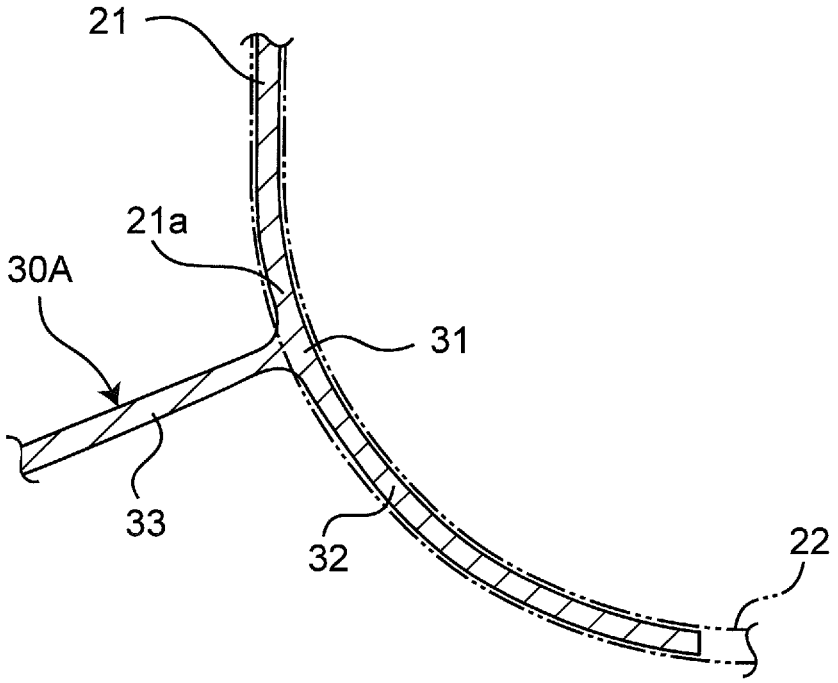
FIG. 6 is an enlarged view of a second embodiment of the coil component of the present disclosure viewed in the lamination direction.

FIG. 6 is an enlarged view of a second embodiment of the coil component of the present disclosure when viewed in the lamination direction. The second embodiment is different from the first embodiment in the shape of the first lead-out conductor. This different configuration will hereinafter be described. The other constituent elements are configured as in the first embodiment and denoted by the same reference numerals as the first embodiment and will not be described.

As shown in FIG. 6, in the coil component of the second embodiment, the lead-out part 33 of the first lead-out conductor 30A is orthogonal to the outer circumferential end 21*a* of the first coil conductor layer 21 when viewed in the lamination direction. Therefore, even if the second coil conductor layer 22 is manufactured by photolithography and the light used for exposure is reflected by the slope of the second insulating layer above the lead-out part 33, the light does not enter the region under the mask for forming the second coil conductor layer 22. As a result, the width of the opening of the photoresist for forming the second coil conductor layer 22 can be achieved as a normal width. Therefore, the occurrence of thinning or disconnection can further be reduced in the second coil conductor layer 22 at a portion adjacent to a portion overlapping with the connecting portion 31 of the first lead-out conductor 30A.

Third Embodiment

Figure 7A:
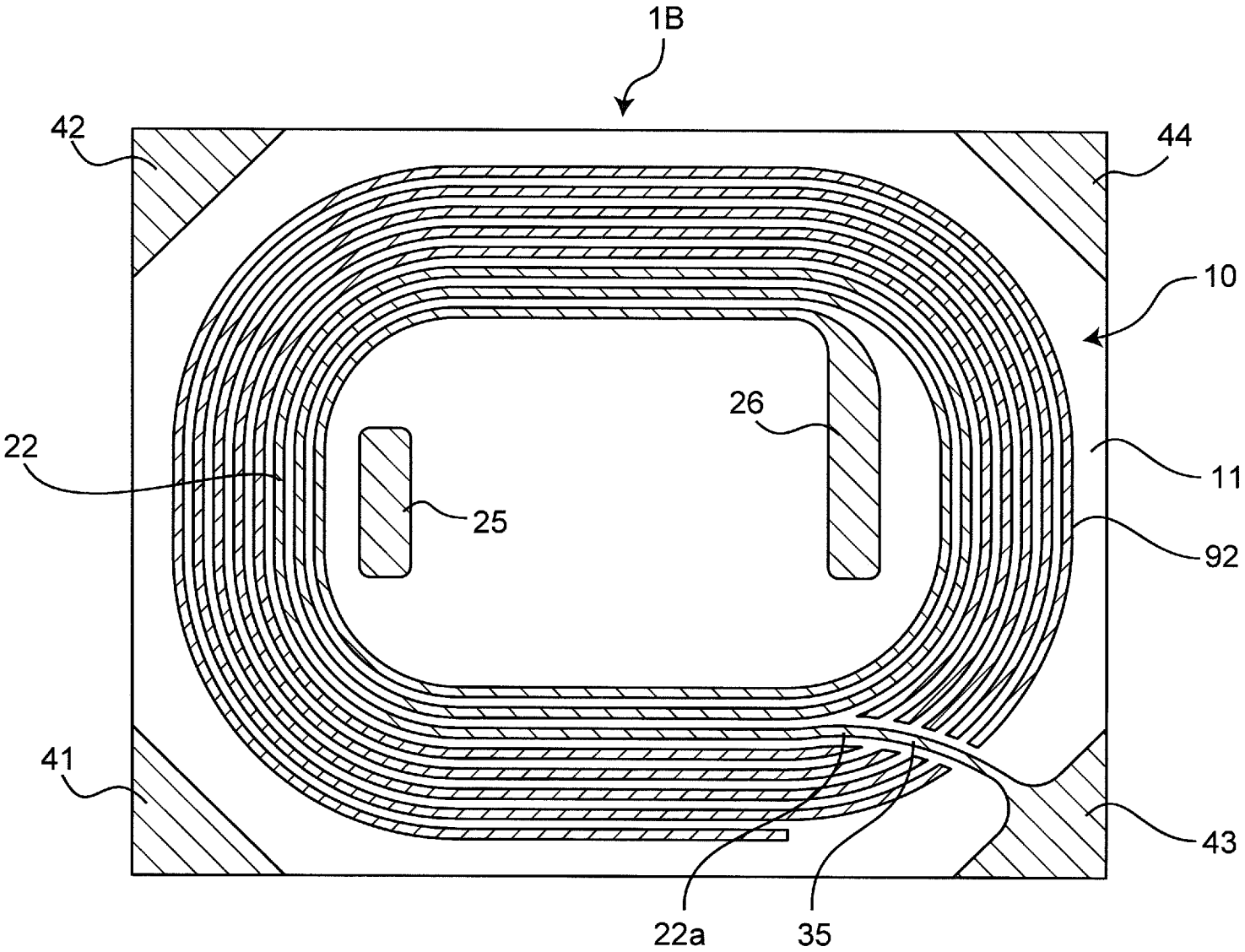
FIG. 7A is an exploded plane view of a third embodiment of the coil component of the present disclosure.
Figure 7B:
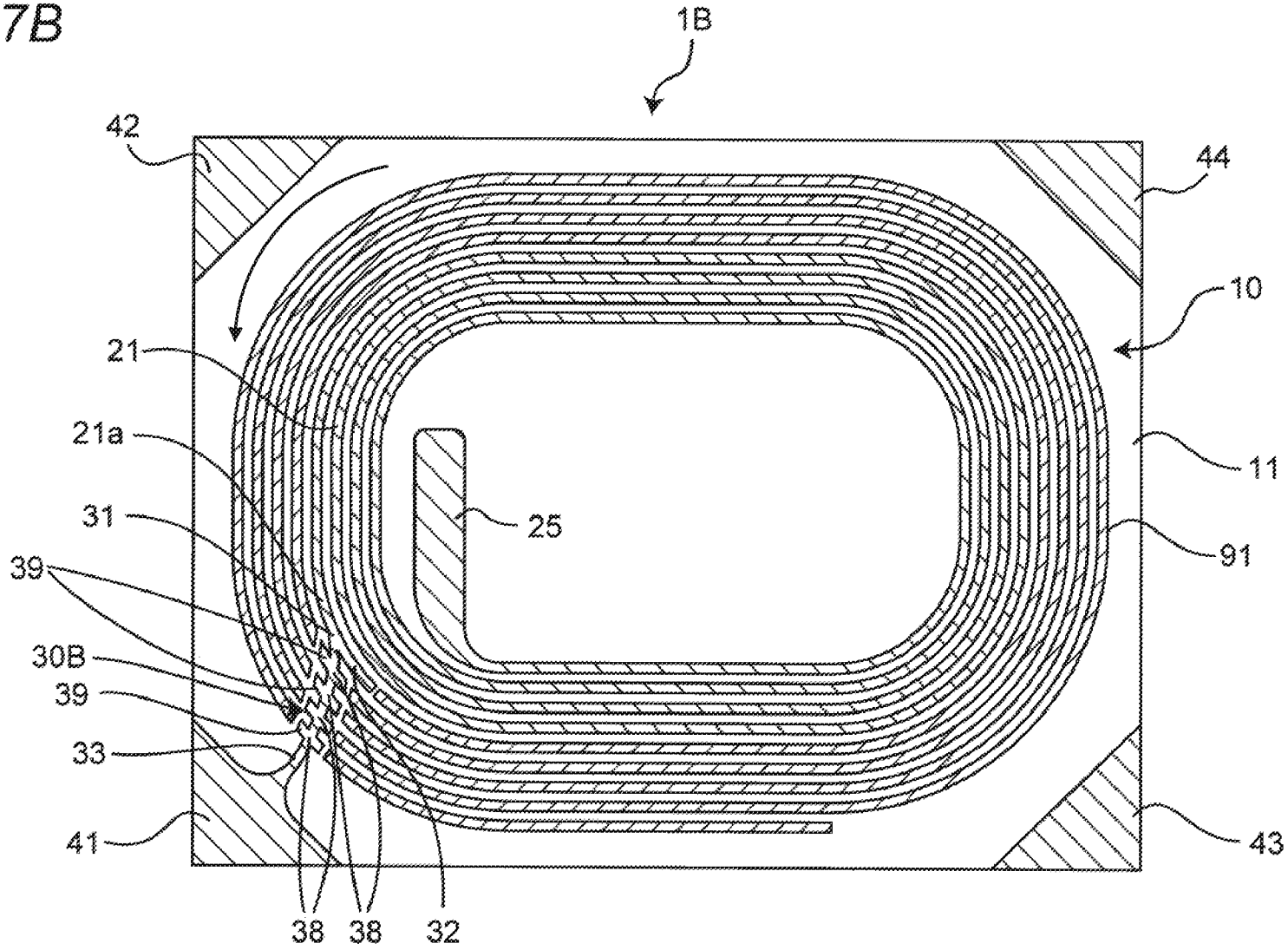
FIG. 7B is an exploded plan view of the third embodiment of the coil component of the present disclosure.

FIGS. 7A and 7B are exploded plane views of a third embodiment of the coil component of the present disclosure. The third embodiment is different from the first embodiment in the configurations of the first lead-out conductor, a first dummy conductor layer, and a second dummy conductor layer. This different configuration will hereinafter be described. The other constituent elements are configured as in the first embodiment and denoted by the same reference numerals as the first embodiment and will not be described.

As shown in FIGS. 7A and 7B, a coil component 1B of the third embodiment includes a first dummy conductor layer 91 and a second dummy conductor layer 92. FIGS. 7A and 7B show layers in order from an upper layer to a lower layer. By disposing the first and second dummy conductor layers 91, 92, the volume of the insulating layer 11 is reduced and the internal stress of the element body 10 can be relaxed.

The first dummy conductor layer 91 is disposed on the same plane as the first coil conductor layer 21 outside the first coil conductor layer 21. The first dummy conductor layer 91 is laminated on the second insulating layer 11*b* together with the first coil conductor layer 21. The first dummy conductor layer 91 is not electrically connected to the first coil conductor layer 21. Therefore, the first dummy conductor layer 91 has a gap from the first coil conductor layer 21 and a first lead-out conductor 30B.

The second dummy conductor layer 92 is disposed on the same plane as the second coil conductor layer 22 outside the second coil conductor layer 22. The second dummy conductor layer 92 is laminated on the third insulating layer 11*c* together with the second coil conductor layer 22. The second dummy conductor layer 92 is not electrically connected to the second coil conductor layer 22. Therefore, the second dummy conductor layer 92 has a gap from the second coil conductor layer 22 and the second lead-out conductor 35.

The first and second dummy conductor layers 91, 92 each have a flat spiral shape wound on a plane. The numbers of turns of the first and second dummy conductor layers 91, 92 are not less than one or may be less than one. The first dummy conductor layer 91 and the second dummy conductor layer 92 concentrically overlap with each other when viewed in the lamination direction.

The lead-out part 33 of the first lead-out conductor 30B is provided with the coil extension part 32 and a dummy extension part 39. The lead-out part 33 and the coil extension part 32 have the same configuration as the first embodiment. The coil extension part 32 extends along the curvature direction of the first coil conductor layer 21 (shown by the arrow in FIG. 7B). The lead-out part 33 includes an intersecting portion 38 intersecting with the second dummy conductor layer 92 when viewed in the lamination direction. The dummy extension part 39 is connected to the intersecting portion 38 and extends to overlap with the second dummy conductor layer 92 when viewed in the lamination direction. The dummy extension part 39 extends in both directions across the lead-out part 33. The length of the dummy extension part 39 is shorter than the length of the coil extension part 32.

According to the coil component 1B, when the second dummy conductor layer 92 is manufactured by photolithography, the occurrence of thinning or disconnection can be reduced in the second dummy conductor layer 92 at a portion adjacent to a portion overlapping with the intersecting portion 38 of the first lead-out conductor 30B, i.e., in the second dummy conductor layer 92 at a portion overlapping with the dummy extension part 39 when viewed in the lamination direction.

In short, as in the description in the first embodiment, even if the second dummy conductor layer 92 is manufactured by photolithography and the light used for exposure is reflected by the slope of the second insulating layer above the lead-out part 33, the light is blocked by the slope of the second insulating layer above the dummy extension part 39 and does not enter the region under the mask for forming the second dummy conductor layer 92 above the dummy extension part 39. As a result, the width of the opening of the photoresist for forming the second dummy conductor layer 92 can be achieved as a normal width. Therefore, the occurrence of thinning or disconnection can be reduced in the second dummy conductor layer 92 at a portion adjacent to a portion overlapping with the intersecting portion 38 of the first lead-out conductor 30B.

Figure 8:
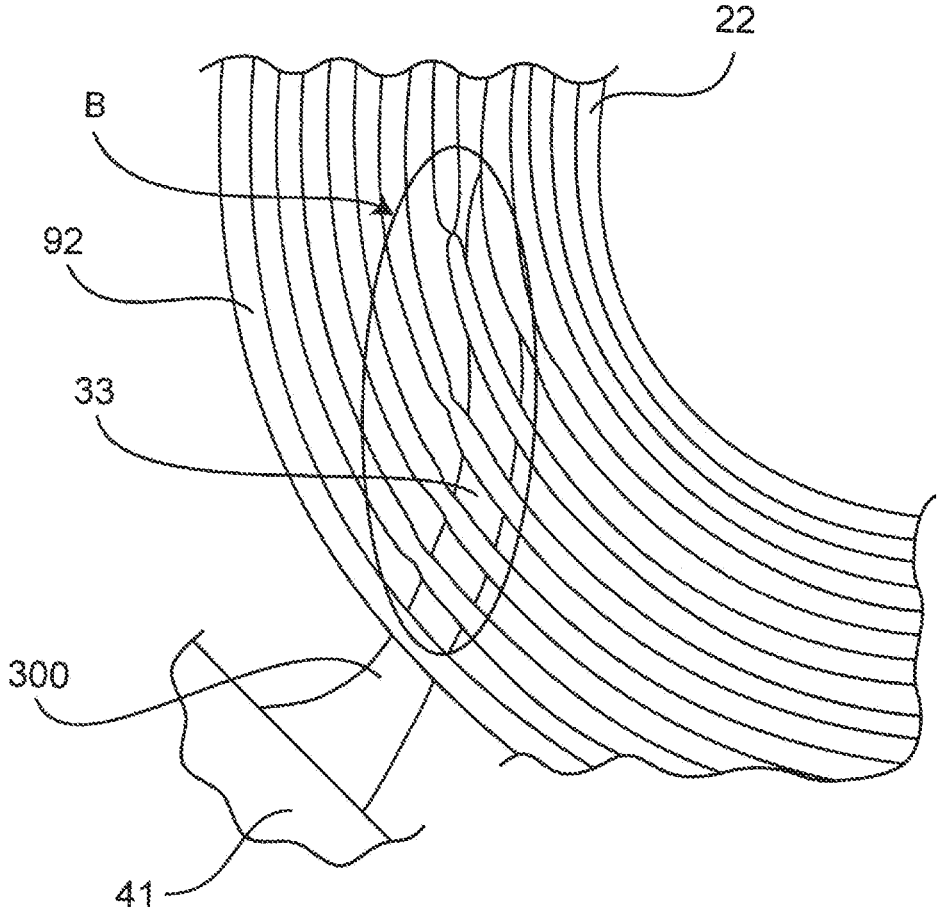
FIG. 8 is an explanatory view for explaining a comparative example of the coil component.

In this regard, a comparative example of a conventional coil component having the first lead-out conductor 300 will be described with reference to FIG. 8. The first lead-out conductor 300 does not include the coil extension part 32 and the dummy extension part 39 of the present disclosure. The same reference numerals as those of FIGS. 7A and 7B have the same configurations and thereof will not be described. As shown in a portion B of FIG. 8, since the first lead-out conductor 300 does not include the dummy extension part 39, thinning has occurred in the second dummy conductor layer 92 at a portion adjacent to a portion intersecting with the first lead-out conductor 300.

A problem in the case of occurrence of thinning or disconnection in the dummy conductor layer will be described. The dummy conductor layer is disposed for the purpose of relatively reducing a region of a portion having a high linear expansion coefficient (the insulating layer 11) in the coil component 1 to relax the internal stress generated by heat, and if the thinning or disconnection partially occurs in the dummy conductor layer, the stress becomes unbalance, which may lead to a reduction in reliability.

The present disclosure is not limited to the embodiments described above and may be changed in design without departing from the spirit of the present disclosure. For example, respective feature points of the first to third embodiments may variously be combined.

Although the first coil conductor layer and the second coil conductor layer constitute respective different inductors in the embodiments, the first coil conductor layer and the second coil conductor layer may be connected to form the same inductor. In this case, the number of the external electrodes is two (two terminals). The coil component is used as an impedance matching coil (matching coil) of a high-frequency circuit, for example.

In the embodiments, the coil component may be used also for a tuning circuit, a filter circuit, and a rectifying/smoothing circuit, for example.

Although the two coil conductor layers are disposed in the embodiments, three or more coil conductor layers may be disposed. In this case, by disposing a coil extension part for a lead-out conductor of a lower coil conductor layer for two coil conductor layers adjacent in the lamination direction, the occurrence of thinning or disconnection can be reduced in an upper coil conductor layer. This configuration may be provided with a dummy conductor layer along with a dummy extension part.

Although the coil extension part and the dummy extension part are disposed in the third embodiment, only the dummy extension part may be disposed without disposing the coil extension part. This can reduce the occurrence of thinning or disconnection of the dummy conductor layer.

What is claimed is:

1. A coil component comprising:

a first coil conductor layer wound on a plane;

a lead-out conductor led out on the same plane as the first coil conductor layer from an outer-circumferential end of the first coil conductor layer;

an insulating layer laminated on the first coil conductor layer and the lead-out conductor; and a second coil conductor layer laminated on the insulating layer and wound on a plane, wherein the first coil conductor layer and the second coil conductor layer concentrically overlap with each other when viewed in a lamination direction, and the lead-out conductor has a connecting portion extending from the first coil conductor layer to an electrode and provided with a coil extension part extending from the connecting portion along a curvature direction of the second coil conductor layer to overlap with the second coil conductor layer when viewed in the lamination direction.

2. A coil component comprising:

a first coil conductor layer wound on a plane;

a lead-out conductor led out on the same plane as the first coil conductor layer from an outer-circumferential end of the first coil conductor layer;

an insulating layer laminated on the first coil conductor layer and the lead-out conductor;

a second coil conductor layer laminated on the insulating layer and wound on a plane, a first dummy conductor layer wound on the same plane as the first coil conductor layer on the outside of the first coil conductor layer without being electrically connected to the first coil conductor layer, and a second dummy conductor layer wound on the same plane as the second coil conductor layer on the outside of the second coil conductor layer without being electrically connected to the second coil conductor layer, wherein the first coil conductor layer and the second coil conductor layer concentrically overlap with each other when viewed in a lamination direction, the lead-out conductor has a connecting portion connected to the first coil conductor layer and provided with a coil extension part extending to overlap with the second coil conductor layer when viewed in the lamination direction, the first dummy conductor layer and the second dummy conductor layer concentrically overlap with each other when viewed in the lamination direction, and when viewed in the lamination direction, the lead-out conductor has an intersecting portion intersecting with the second dummy conductor layer and provided with a dummy extension part extending to overlap with the second dummy conductor layer.

3. A coil component comprising:

a first coil conductor layer wound on a plane;

a lead-out conductor led out on the same plane as the first coil conductor layer from an outer-circumferential end of the first coil conductor layer;

an insulating layer laminated on the first coil conductor layer and the lead-out conductor;

a second coil conductor layer laminated on the insulating layer and wound on a plane;

a first dummy conductor layer wound on the same plane as the first coil conductor layer on the outside of the first coil conductor layer without being electrically connected to the first coil conductor layer; and a second dummy conductor layer wound on the same plane as the second coil conductor layer on the outside of the second coil conductor layer without being electrically connected to the second coil conductor layer, wherein the first coil conductor layer and the second coil conductor layer concentrically overlap with each other when viewed in a lamination direction, the first dummy conductor layer and the second dummy conductor layer concentrically overlap with each other when viewed in the lamination direction, and when viewed in the lamination direction, the lead-out conductor has an intersecting portion intersecting with the second dummy conductor layer and provided with a dummy extension part extending to overlap with the second dummy conductor layer.

4. The coil component according to claim 1, wherein:

the electrode is connected to the lead-out conductor, the lead-out conductor has a lead-out part extending from an outer circumferential end of the first coil conductor layer to the electrode, and the lead-out part is orthogonal to the outer circumferential end of the first coil conductor layer when viewed from the lamination direction.

5. The coil component according to claim 1, wherein the first coil conductor layer has a thickness from 5 μm to 15 μm.

6. The coil component according to claim 1, wherein the second coil conductor layer has an aspect ratio of 1 to 2.5.

7. The coil component according to claim 2, wherein:

the coil component has an electrode connected to the lead-out conductor, the lead-out conductor has a lead-out part extending from an outer circumferential end of the first coil conductor layer to the electrode, and the lead-out part is orthogonal to the outer circumferential end of the first coil conductor layer when viewed from the lamination direction.

8. The coil component according to claim 3, wherein:

the coil component has an electrode connected to the lead-out conductor, the lead-out conductor has a lead-out part extending from an outer circumferential end of the first coil conductor layer to the electrode, and the lead-out part is orthogonal to the outer circumferential end of the first coil conductor layer when viewed from the lamination direction.

9. The coil component according to claim 2, wherein the first coil conductor layer has a thickness from 5 μm to 15 μm.

10. The coil component according to claim 3, wherein the first coil conductor layer has a thickness from 5 μm to 15 μm.

11. The coil component according to claim 4, wherein the first coil conductor layer has a thickness from 5 μm to 15 μm.

12. The coil component according to claim 7, wherein the first coil conductor layer has a thickness from 5 μm to 15 μm.

13. The coil component according to claim 8, wherein the first coil conductor layer has a thickness from 5 μm to 15 μm.

14. The coil component according to claim 2, wherein the second coil conductor layer has an aspect ratio of 1 to 2.5.

15. The coil component according to claim 3, wherein the second coil conductor layer has an aspect ratio of 1 to 2.5.

16. The coil component according to claim 4, wherein the second coil conductor layer has an aspect ratio of 1 to 2.5.

17. The coil component according to claim 5, wherein the second coil conductor layer has an aspect ratio of 1 to 2.5.

18. The coil component according to claim 7, wherein the second coil conductor layer has an aspect ratio of 1 to 2.5.

19. The coil component according to claim 8, wherein the second coil conductor layer has an aspect ratio of 1 to 2.5.

20. A method of manufacturing a coil component according to claim 1, comprising:

disposing the first coil conductor layer wound on a plane and the lead-out conductor led out on the same plane as the first coil conductor layer from an outer-circumferential end of the first coil conductor layer to the outside and disposing the coil extension part extending along a winding shape of the first coil conductor layer at a connecting portion of the lead-out conductor connected to the first coil conductor layer;

laminating the insulating layer on the first coil conductor layer and the lead-out conductor;

disposing a photoresist on the insulating layer;

exposing the photoresist after a mask to shield light is placed at positions overlapping with the first coil conductor layer and the coil extension part when viewed in the lamination direction;

removing a portion of the photoresist not exposed due to the mask, and disposing the second coil conductor layer in the removed portion of the photoresist.

* * * * *